US005616102A

United States Patent [19]

Lahmann

[11] Patent Number: 5,616,102

[45] Date of Patent: Apr. 1, 1997

[54] GYMNASTIC BALANCE BEAM WITH ARTICULATED BEAM PORTIONS

[76] Inventor: Gerald J. Lahmann, 11506 W. Clarke St., Wauwatosa, Wis. 53226

[21] Appl. No.: 492,374

[22] Filed: Jun. 19, 1995

[51] Int. Cl.[6] ..... A63B 4/00

[52] U.S. Cl. ..... 482/34; 434/258

[58] Field of Search ..... 482/34; 434/258

[56] References Cited

U.S. PATENT DOCUMENTS

| | | | |
|---|---|---|---|
| D. 308,698 | 6/1990 | Dorman . | |
| 3,510,129 | 5/1970 | Reuther . | |
| 3,545,747 | 12/1970 | Thomas | 482/34 |
| 3,580,568 | 5/1971 | Stone | 482/34 |
| 3,589,716 | 6/1971 | Footlik . | |
| 3,944,656 | 3/1976 | Moore . | |
| 3,990,697 | 11/1976 | Reuther . | |
| 4,105,201 | 8/1978 | L'Ecuyer et al. . | |
| 4,272,073 | 6/1981 | Grosser et al. . | |
| 4,378,112 | 3/1983 | Goldstein . | |
| 4,448,411 | 5/1984 | Parker . | |
| 5,037,086 | 8/1991 | Strand . | |
| 5,133,699 | 7/1992 | Cooper . | |
| 5,389,054 | 2/1995 | Dorman . | |

*Primary Examiner*—Lynne A. Reichard
*Attorney, Agent, or Firm*—Jansson & Shupe, Ltd.

[57] ABSTRACT

A gymnastic apparatus has an elongate beam member which includes first and second articulated beam portions coupled to one another by a coupling mechanism. The portions may thereby be oriented angularly to one another to permit simultaneous use of the apparatus by two gymnasts. Such portions may also be separated from one another for independent use. Either beam portion includes an indicium, e.g., the letter L, the letter R, or the word LEFT or RIGHT, corresponding to a "hand" of a gymnast standing on the other beam portion. Such indicium also preferably includes a color component.

5 Claims, 6 Drawing Sheets

GYMNASTIC BALANCE BEAM WITH ARTICULATED BEAM PORTIONS

FIELD OF THE INVENTION

This invention relates generally to exercise devices and, more particularly, to devices used in gymnastics.

BACKGROUND OF THE INVENTION

Exercise devices have been popular as a way of attaining or maintaining physical fitness and are becoming increasingly so. Such devices are used by individuals working alone and in organized competitive events in schools and colleges. Some exercise devices are used in international Olympic events.

One category of such devices includes gymnastic equipment, e.g., rings, trapeze and the balance beam. As the name suggests, a balance beam is a rail-like structure which presents a long, relatively-narrow top surface to the gymnast's foot. Merely walking on such a surface is, to many, difficult and performing acrobatic maneuvers thereon requires a high degree of skill.

A number of examples of gymnastic balance beams are shown in the patent literature including U.S. Pat. Nos. 3,990,697 (Reuther); 4,105,201 (L'Ecuyer et al.); 4,272,073 (Grosser et al.) and 5,037,086 (Strand) and others. An unusual type of balance beam (seemingly not suitable for competition training) is shown in U.S. Pat. No. 3,944,654 (Moore) and balance beams having certain non-gymnastic educational features are shown in U.S. Pat. No. Designs 308,698 (Dorman) and U.S. Pat. No. 5,389,054 (Dorman). The beam of the former Dorman patent helps learn geometric symbols, numerals and alphabet while that of the latter Dorman patent helps learn geometric symbols.

Known balance beams (including those of the above-noted patents) have doubtless been generally satisfactory for their purposes. But in view of the invention, they lack certain features or "enhancements" for employing the balance beam as an easily-used educational tool at the pre-school and elementary and high school levels.

At those levels, teachers often wish to concentrate upon multi-discipline educational opportunities where possible and upon developing reasonably proficient balance beam skills rather than top-notch, highly-competitive skills. And teachers need equipment that is easy to use and transport and that can be adapted to a variety of instructional situations.

As an example of how prior art balance beams are not fully responsive to the aforementioned needs, the Reuther and Strand patents both involve elevated balance beams that, while desirable for an accomplished gymnast, are much too high above the floor for a beginner to safely use. And the balance beams of the Reuther, Strand, Grosser et al. and L'Ecuyer et al. patents are apparently incapable of being easily dismantled or shortened for easy carrying. One need only consider that a non-foldable balance beam is very difficult to transport from place to place.

Yet another disadvantage of conventional balance beams is that they are not well suited for use by more than one person. Group learning situations, e.g., "physical education classes," would be improved by balance beam equipment which can be used simultaneously by two or more persons and which can be used on surfaces which are other than absolutely horizontal and planar. Insofar as is known, there is no balance beam responsive to those needs. Nor are known balance beams instructive in such important pre-school concepts as left- and right-handedness and color including primary colors.

An improved gymnastic apparatus which is suitable for beginning balance beam gymnasts, which affords an opportunity for multi-discipline learning, which is easy to transport, which is configured for use by one or two persons or by one or two groups of persons and which aids instruction in certain pre-school educational concepts would be an important advance in the art.

OBJECTS OF THE INVENTION

It is an object of the invention to provide an improved gymnastic apparatus overcoming some of the problems and shortcomings of the prior art.

Another object of the invention is to provide an improved gymnastic apparatus suitable for use by beginning balance beam gymnasts.

Another object of the invention is to provide an improved gymnastic apparatus which affords an opportunity for multi-discipline learning.

Yet another object of the invention is to provide an improved gymnastic apparatus which is easy to transport.

Another object of the invention is to provide an improved gymnastic apparatus which may be configured for simultaneous use by one or two persons.

Another object of the invention is to provide an improved gymnastic apparatus which may be configured for simultaneous use by one or two groups of persons.

Still another object of the invention is to provide an improved gymnastic apparatus which aids instruction in certain pre-school and elementary school educational concepts.

Another object of the invention is to provide an improved gymnastic apparatus which may be used on uneven surfaces including out-of-door areas. How these and other objects are accomplished will become apparent from the following descriptions and from the drawings.

SUMMARY OF THE INVENTION

The invention involves a gymnastic apparatus, e.g., a balance beam, of the type having an elongate beam member. In the improvement, the beam member includes first and second articulated beam portions which may be coupled to or uncoupled from one another. Such portions may be coupled to and oriented angularly to one another to permit simultaneous use of the apparatus by two gymnasts. Or such portions may be separated for independent use by different gymnasts or groups of gymnasts.

In a more detailed aspect of the invention, the first beam portion has first and second ends and each of such ends has a foot-like support device coupled to it. Such device supports the first beam portion in spaced relationship to a surface such as a gymnasium floor. Similarly, the second beam portion has first and second ends and each of the ends of such portion has a support device coupled thereto. To accommodate the new apparatus to a surface, e.g., a grassy area, which may be uneven, at least one of the support devices is adjustable in height. Most preferably, the support devices generally at the middle of the apparatus are adjustable.

Enlightened teaching strategies encourage simultaneous exposure of a student to "multi-disciplines" of learning. The new apparatus is useful in such a strategy in that it exposes a young gymnast to concepts such as "handedness," e.g., left hand and right hand, and/or to color. In specific embodiments, the second beam portion includes an indicium corresponding to a hand of a gymnast standing on the first beam portion. When so positioned, the gymnast is able to see such indicium. Similarly, the first beam portion includes an indicium corresponding to a hand of a gymnast standing on the second beam portion. Each of the indicium corresponds to the right hand or to the left hand of the gymnast and such indicium may optionally include a color component.

More specifically, each of the indicium indicating "handedness" may include an indicium representing "left" or "right," e.g., the actual word "left" or "right" or a mnemonic indicium such as the letter L or R. Most preferably, each of the indicium also includes color in the form of a primary-colored panel or portion. When so configured, the new apparatus simultaneously teaches gymnastics, the concepts of left and right hand and color. Such apparatus is particularly useful when teaching very young gymnasts, e.g., those of ages 4 through 7 or so.

In another aspect of the invention, the beam portions are joined (or capable of being joined) to one another by a hinge-like coupling mechanism. Such mechanism has plural mechanism components detachable from one another so that the portions may be separated for independent use at rather widely-spaced locations.

More specifically, each beam portion has a first side surface and a second side surface generally horizontally spaced from the first surface. The coupling mechanism extends between the first surfaces of the two beam portions and the apparatus includes a locking mechanism extending between the second surfaces. When the components of the coupling mechanism are attached to one another and when the locking mechanism is secured, relative movement of the portions one to another in a horizontal plane is substantially prevented. In other words, the apparatus is linear, the beam portions are collinear, the first side surfaces are generally coplanar with one another and the second side surfaces are generally coplanar with one another.

The new apparatus is configured in recognition of the fact that it may be desirable to fold the beam portions substantially against one another for apparatus carrying or for use as a double-width beam by persons for whom a beam of conventional width is initially too difficult to use. The coupling mechanism is between the first end of the first beam portion and the second end of the second beam portion and a fastener device is between the second end of the first beam portion and the first end of the second beam portion. The beam portions may be folded parallel and secured in such folded position for carrying or for use by "special populations" as described above.

Other details of the new apparatus are set forth in the following detailed description and in the drawings.

DETAILED DESCRIPTIONS OF PREFERRED EMBODIMENTS

Figure 1:
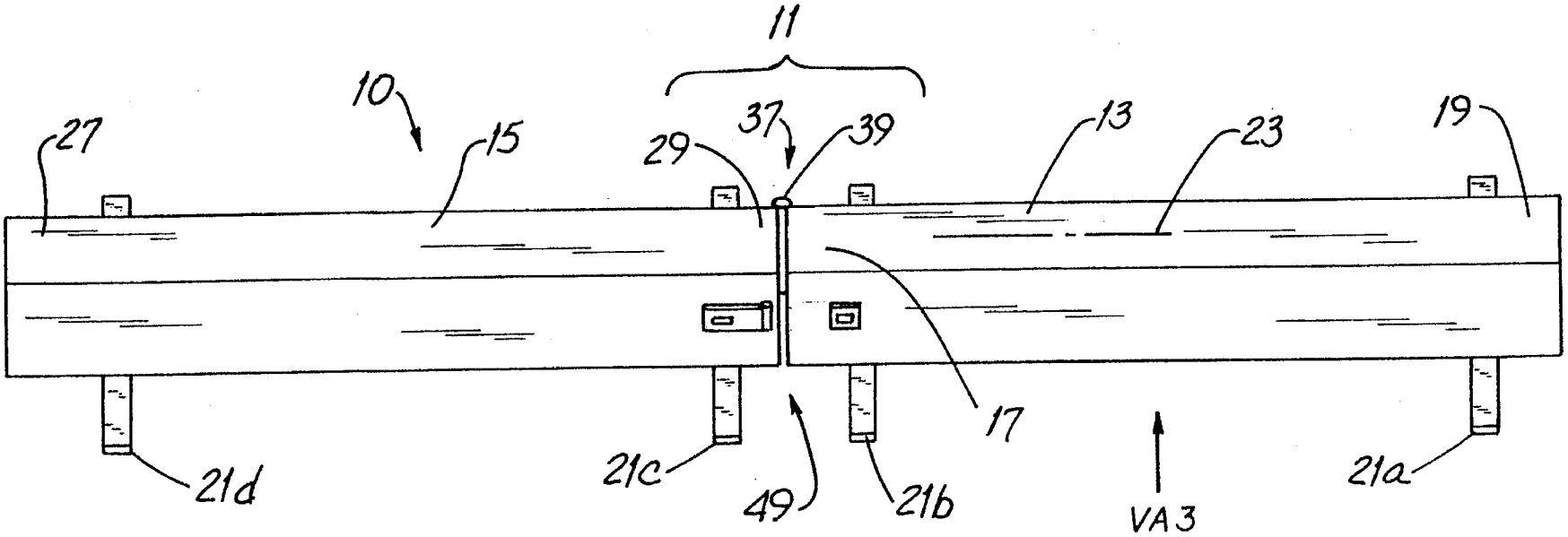
FIG. 1 is a side perspective view of the new apparatus with its articulated beam portions collinear.
Figure 3:
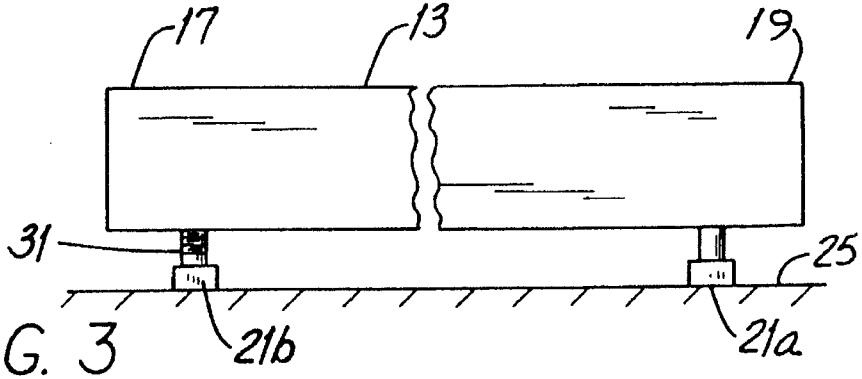
FIG. 3 is a side elevation view of one of the apparatus beam portions taken generally along the viewing axis VA3 of FIG. 1.
Figure 2:
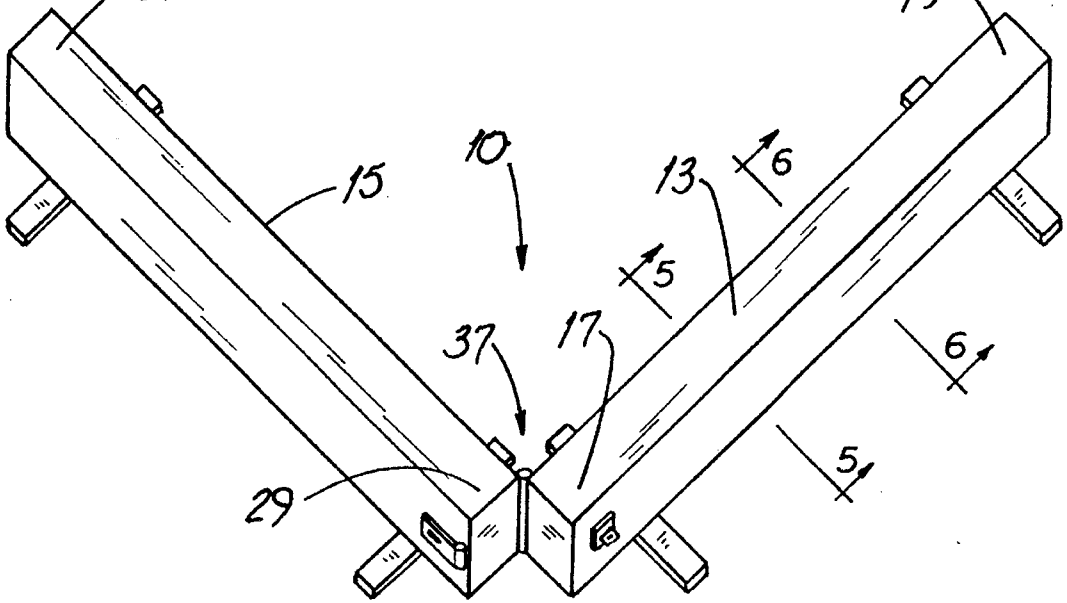
FIG. 2 is a perspective view of the apparatus of FIG. 1 with its articulated beam portions coupled together and oriented angularly to one another.

Referring to FIGS. 1, 2 and 3, the new gymnastic apparatus 10 comprises an elongate beam member 11 having first and second articulated beam portions 13 and 15, respectively. As described in more detail below, such portions 13, 15 may be coupled to or uncoupled from one another and when coupled together, may be oriented angularly to one another to permit simultaneous use of the apparatus 10 by two gymnasts or by two groups of gymnasts. Or such portions 13, 15 may be separated for independent use by different gymnasts or groups of gymnasts.

The first beam portion 13 has first and second ends 17 and 19 and each of such ends 17, 19 has a foot-like support device 21 coupled to it. Each such device 21 is itself elongate, oriented laterally to the long axis 23 of the beam portion 13 and supports such portion 13 in spaced relationship to a surface such as a gymnasium floor.

Similarly, the second beam portion 15 has first and second ends 27 and 29 and each of the ends 27, 29 has a support device 21 coupled thereto. To accommodate the new apparatus 10 to a surface which may be uneven, e.g., an outdoor grassy area, at least one of the support devices 21 (e.g., device **21*b* and/or 21*c*) is vertically adjustable in height. Adjustment is by a threaded shank 31. In a specific exemplary embodiment, the support devices 21*b*, 21*c* generally near the middle of the apparatus 10** are adjustable.

Figure 4:
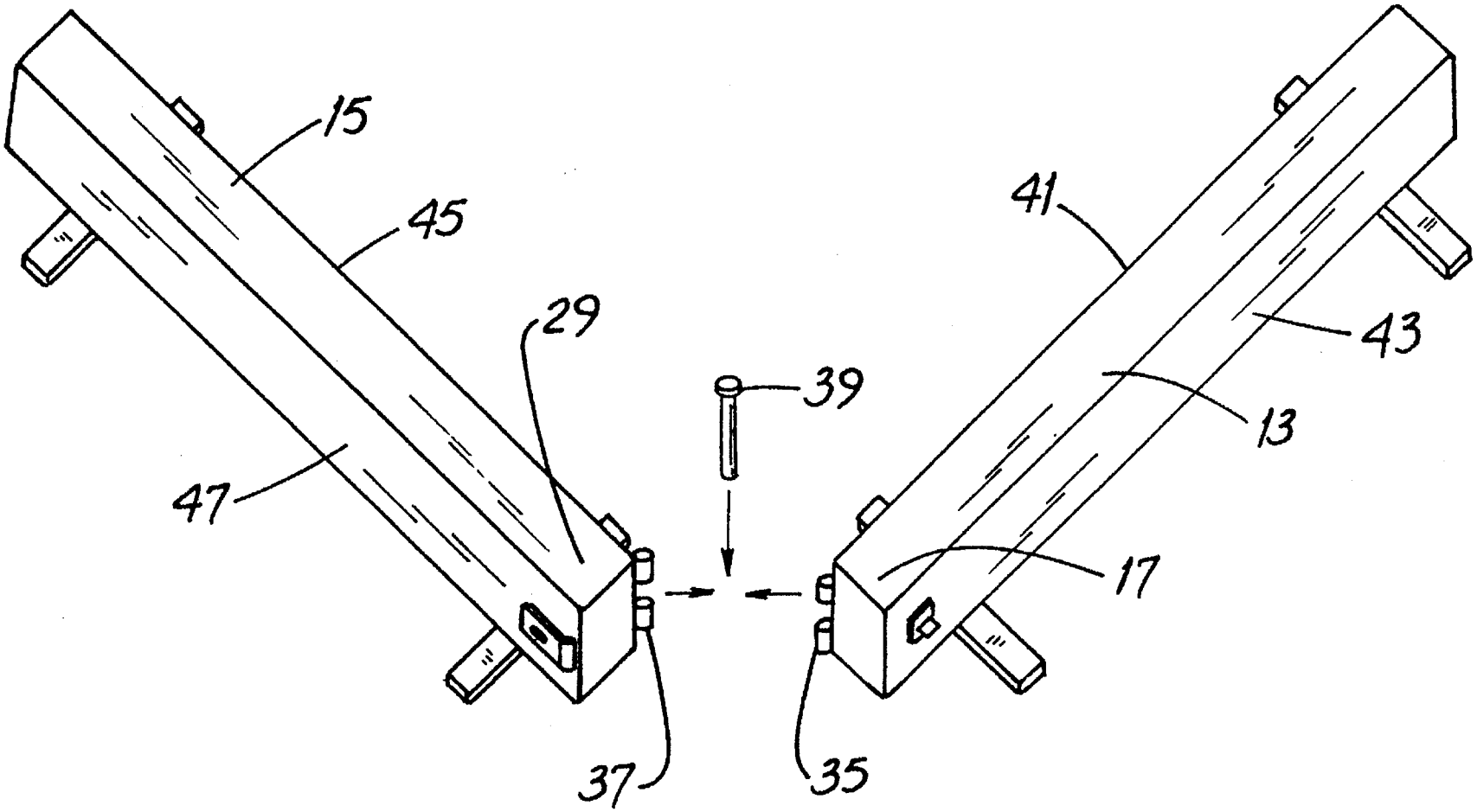
FIG. 4 is a perspective view of the apparatus of FIG. 1 with its articulated beam portions detached from one another for independent use.

Referring also to FIG. 4, the beam portions 13, 15 are joined (or capable of being joined) to one another by a hinge-like coupling mechanism 33. Such mechanism 33 has two mechanism components 35, 37, with the first component 35 secured at the first end of the first beam portion and the second component 37 secured at the second end 29 of the second beam portion 15. The components 35, 37 are joined by a removable pin 39 permitting detachment of the beam portions 13, 15 from one another so that such portions 13, 15 may be separated for independent use at rather widely-spaced locations in, e.g., a gymnasium.

More specifically, the first beam portion 13 has a first side surface 41 and a second side surface 43 generally horizontally spaced from the first surface 41. Likewise, the second beam portion 15 has a first side surface 45 and a second side surface 47 generally horizontally spaced from the first surface 45. The mechanism components 35 and 37 and are attached to the first surfaces 41 and 45, respectively, and the coupling mechanism 33 extends between such first surfaces 41, 45 of the two beam portions 13, 15.

As particularly shown in FIGS. 1 and 2, the apparatus 10 includes a locking mechanism 49 extending between the second surfaces 43, 47. When the components 35, 37 of the coupling mechanism 33 are attached to one another and when the locking mechanism 49 is secured, relative movement of the portions 13, 15 one to another in a horizontal plane is substantially prevented. In other words, the apparatus 10 is then linear, the beam portions 13, 15 are collinear, the first side surfaces 41, 45 are generally coplanar and the second side surfaces 43, 47 are generally coplanar.

Figure 5:
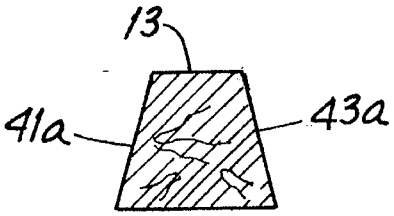
FIG. 5 is a representative section view of one of the beam portions taken from the perspective of the viewing plane 5—5 of FIG. 2 and showing an alternate arrangement of the portion side surfaces.
Figure 6:
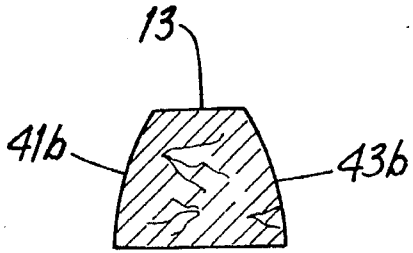
FIG. 6 is a representative section view of one of the beam portions taken from the perspective of the viewing plane 6—6 of FIG. 2 and showing another alternate arrangement of the portion side surfaces.

(It is to be appreciated that in the exemplary embodiment, the side surfaces 41, 43, 45, 47 of the beam portions 13, 15 are vertical when the apparatus 10 is erected on a horizontal floor 25. Angled, generally planar side surfaces 41*a*, 43*a* as shown in FIG. 5 or angled, curvilinear side surfaces 41*b*, 43*b* as shown in FIG. 6 are contemplated by the invention. Persons of ordinary skill will recognize, however, that the utility of the apparatus 10 will be improved if those small areas of the side surfaces 41, 45 and 43, 47 to which the coupling mechanism 33 and the locking mechanism 49 are respectively secured are vertical.)

Figure 7:
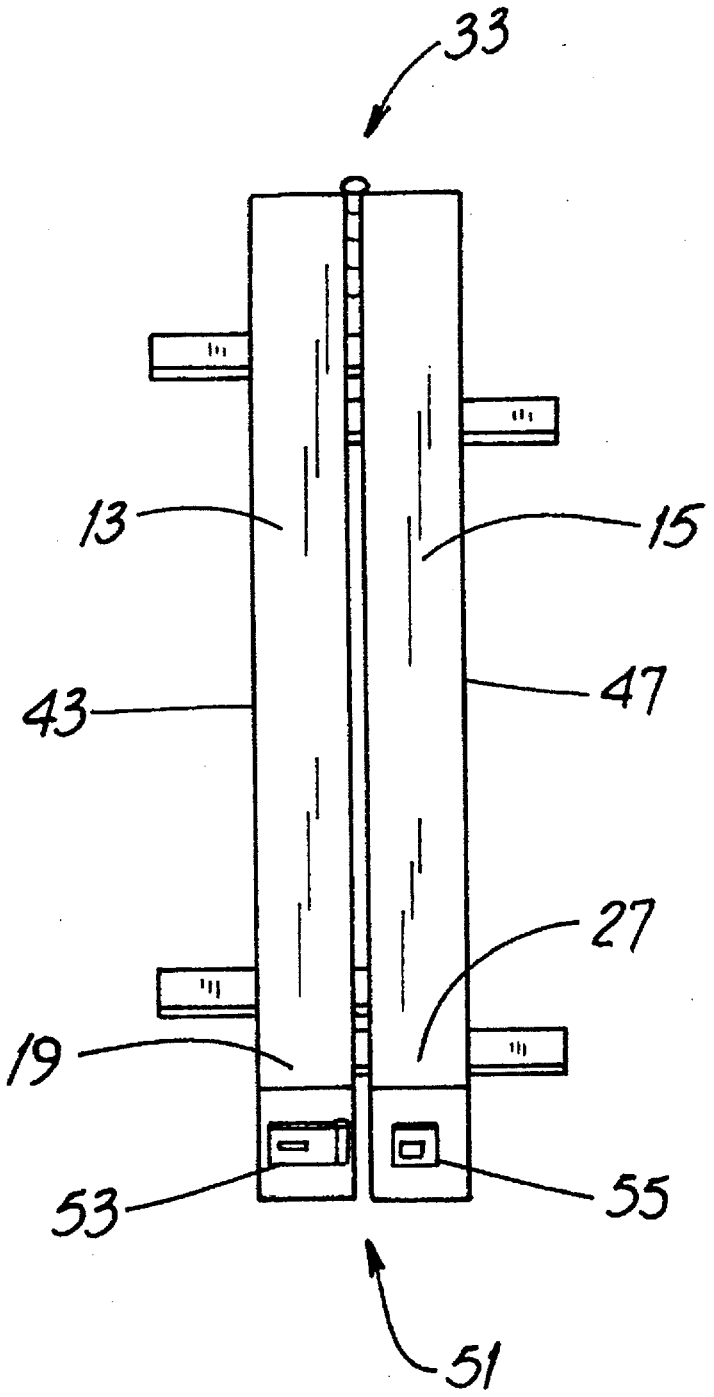
FIG. 7 is a perspective view of the apparatus of FIG. 1 with its articulated beam portions folded together for storage or carrying.

Referring also to FIG. 7, the new apparatus 10 is configured in recognition of the fact that it is or may be desirable to be able to fold the beam portions 13, 15 substantially against one another for apparatus carrying. To that end, a fastener device 51 has device components 53 and 55 mounted respectively on the second end 19 of the first beam portion 13 and on the first end 27 of the second beam portion 15. The beam portions 13, 15 may be folded parallel and secured in such folded position for carrying by coupling the components 53, 55 and to one another using a pin, padlock, C-clip or the like.

Figure 8:
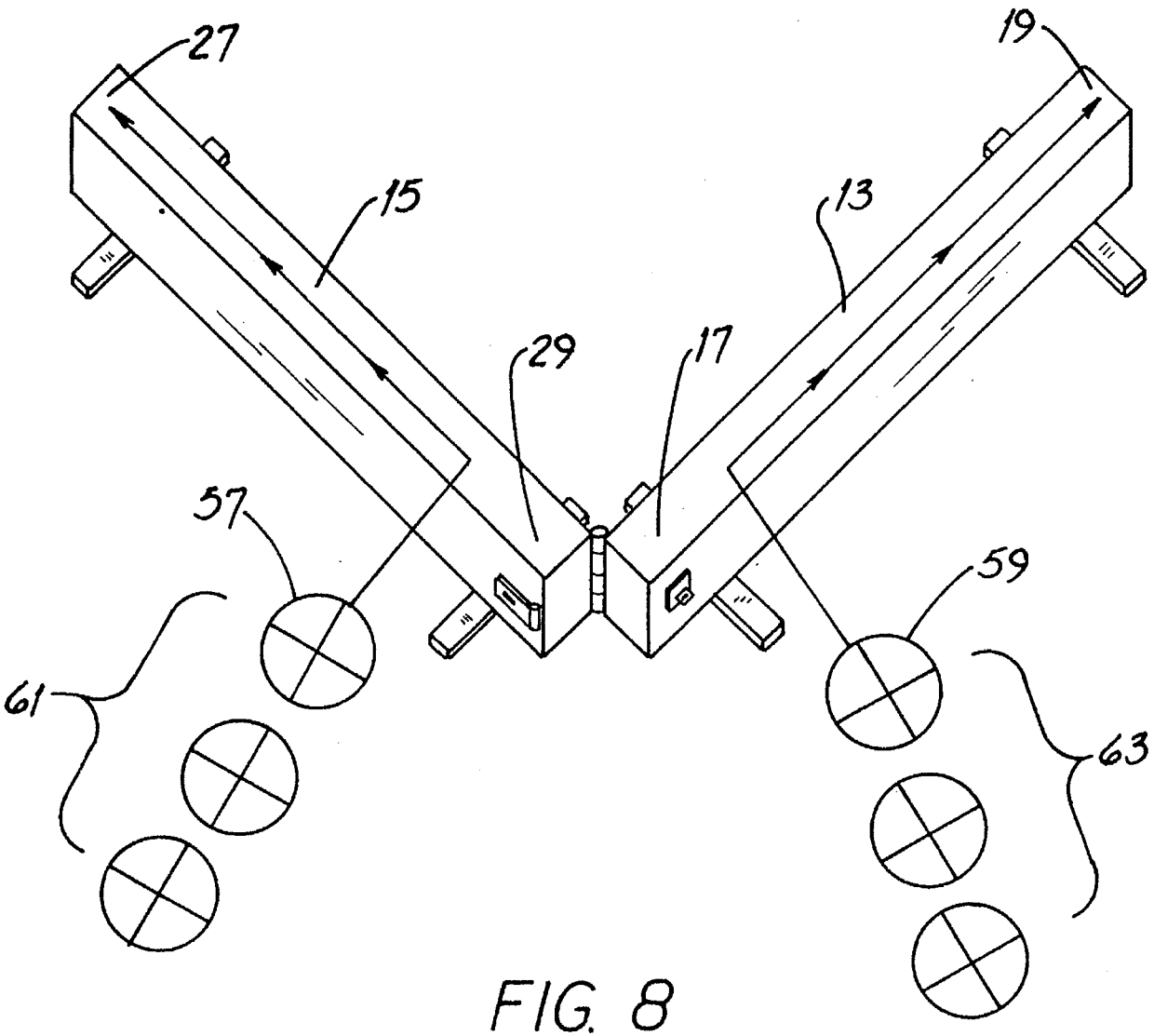
FIG. 8 is a perspective view like that of FIG. 2 showing how the new apparatus may be simultaneously used by each of two students and by each of two groups of students.

Considering FIG. 8, it is now apparent that the two beam portions 13, 15 may be coupled together and angularly oriented to one another to permit each of two students 57, 59 a student being represented by a "circle X" symbol ) and each of two groups of students 61, 63 to use the apparatus 10 simultaneously. This is a particularly desirable teaching feature when the apparatus 10 is used to train beginning and novice gymnasts as in a pre-school, elementary school or high school setting. An instructor can supervise and provide training for a maximum number of students with a minimum financial outlay for equipment.

Figure 9:
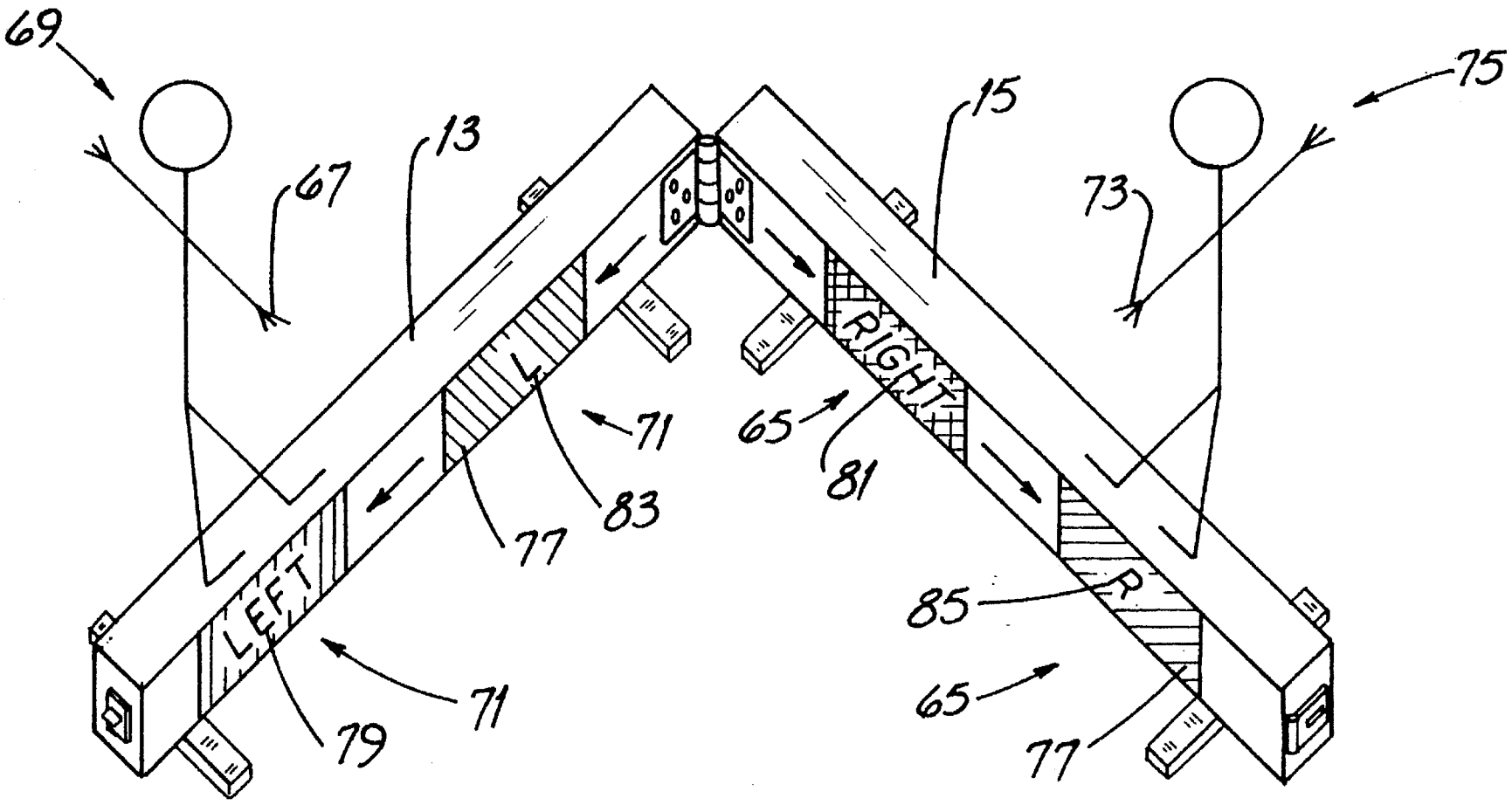
FIG. 9 is a perspective view of the apparatus of FIG. 1 showing optional "handedness" indicia and color panels for multi-discipline teaching.

And that is not all. Enlightened teaching strategies encourage simultaneous exposure of a student to "multi-disciplines" of learning. The new apparatus 10 is useful in such a strategy in that it exposes a young gymnast to concepts such as "handedness," e.g., left hand and right hand, and/or to color. Referring also to FIG. 9, in specific embodiments, one of the beam portions 13, 15, e.g., the second beam portion 15 includes an indicium 65 corresponding to a hand 67 of a gymnast 69 standing on the first beam portion 13. When so positioned, the gymnast 69 is able to see such indicium 65. Similarly (or the alternative), the first beam portion 13 includes an indicium 71 corresponding to a hand 73 of a gymnast 75 standing on the second beam portion 15. Such indicium 65, 71 may optionally include a color portion or panel component 77 such as a primary color (red, yellow or green) or non-primary color.

More specifically, each of the indicium 65, 71 indicating "handedness" may include the actual word "left" or "right" 79 or 81, respectively, or a mnemonic symbol 83, 85 such as the letter L or R respectively. When so configured, the new apparatus 10 simultaneously teaches gymnastics, the concepts of left and right hand and color.

While the principles of the new apparatus 10 have been shown and described in connection with specific embodiments, it is to be understood clearly that such embodiments are exemplary and not limiting.

What is claimed:

1. In a gymnastic apparatus having an elongate beam member, the improvement wherein:

the beam member includes first and second beam portions attached together by a coupling mechanism;

the coupling mechanism has first and second mechanism components attached to the first and second beam portions, respectively;

the components are detachably joined to one another by a removable pin; and each beam portion includes an undersurface and a pair of support devices attached to each undersurface of each beam portion for supporting a respective beam portion in spaced relationship above a floor, whereby the beam portions may be separated from one another to permit simultaneous use of the apparatus by two gymnasts.

2. The apparatus of claim 1 wherein:

the first beam portion has first and second ends;

the second beam portion has first and second ends;

the coupling mechanism joins the first end of the first beam portion and the second end of the second beam portion; and the apparatus includes a locking mechanism joining the first end of the first beam portion and the second end of the second beam portion when the beam portions are oriented collinear with one another.

3. The apparatus of claim 1 wherein at least one of the support devices is adjustable in height.

4. A folded balance beam apparatus comprising first and second beam portions and wherein:

the first beam portion has first and second ends and a first side surface;

the second beam portion has first and second ends and a first side surface;

the first end of the first beam portion and the second end of the second beam portion are joined together by a hinge mechanism;

the side surfaces of the beam portions are substantially abutting; and the apparatus includes a fastener device spaced from the hinge mechanism and spanning the beam portions, whereby relative movement of the portions one to another in a horizontal plane is substantially prevented.

5. The apparatus of claim 4 wherein:

the locking mechanism extends between the first end of the second beam portion and the second end of the first beam portion.

* * * * *